United States Patent [19]

Hooper

[11] 4,210,108

[45] Jul. 1, 1980

[54] STEPPED PISTON TWO-STROKE ENGINES

[76] Inventor: Bernard Hooper, Maybank House, Hope St., Wordsley, Stourbridge, W. Midlands, England

[21] Appl. No.: 944,566

[22] Filed: Sep. 21, 1978

[30] Foreign Application Priority Data

Sep. 22, 1977 [GB] United Kingdom ..... 39510/77

[51] Int. Cl.[2] ..... F02B 75/02

[52] U.S. Cl. ..... 123/65 S; 123/59 BS; 123/66; 123/67; 123/71 R

[58] Field of Search ..... 123/65 S, 66, 67, 59 BS, 123/71 R, 65 R

[56] References Cited

U.S. PATENT DOCUMENTS

| | | | |
|---|---|---|---|
| 1,040,153 | 10/1912 | Crothers | 123/65 S |
| 1,139,770 | 5/1915 | Joswich | 123/65 S |
| 1,907,354 | 5/1933 | Hansen | 123/59 BS |
| 1,933,002 | 10/1933 | Beyer | 123/66 X |
| 3,550,569 | 12/1970 | Hooper | 123/71 R |
| 4,068,629 | 1/1978 | Hooper | 123/65 S |

FOREIGN PATENT DOCUMENTS

| | | | |
|---|---|---|---|
| 1013920 | 8/1957 | Fed. Rep. of Germany | 123/65 S |
| 1171767 | 11/1969 | United Kingdom | 123/65 S |
| 1303251 | 1/1973 | United Kingdom | 123/59 BS |

*Primary Examiner*—Wendell E. Burns

*Attorney, Agent, or Firm*—Schwartz, Jeffery, Schwaab, Mack, Blumenthal & Koch

[57] ABSTRACT

A two-stroke internal combustion engine having a stepped piston in which the cylinder casting has a bore of greater diameter to form a pumping part, a bore of lesser diameter to form a working part, exhaust port means in the working part and opposed transfer port means on opposite sides of the working part disposed symmetrically about a plane passing through the longitudinal axis of the cylinder and center of the exhaust port means, the transfer port means being of a form to be produced in the casting process by non-separate cores introduced linearly towards the plane.

13 Claims, 3 Drawing Figures

STEPPED PISTON TWO-STROKE ENGINES

BACKGROUND OF THE INVENTION

1. Field of the Invention

This invention relates to a two-stroke internal combustion engine having a cylinder containing a stepped piston, the cylinder and piston having a pumping part, of larger diameter and a working part, of smaller diameter, there being associated with the cylinder at least one receiver volume arranged to receive, through transfer port means in the working part of the cylinder, a charge from the pumping part of the cylinder and to deliver through said transfer port means the charge to the working part of the cylinder. In such an engine, the piston is provided with recess means which co-operate with the transfer port means to allow and control entry of the charge into the or each receiver volume, the piston also co-operating with the transfer port means to allow and control entry of charge from the or each receiver volume to the working part of the cylinder. Such an engine will hereafter be referred to as an engine of the kind specified. One example of such an engine is described in British Patent Specification No. 1,171,767.

2. Description of the Prior Art

In two stroke engines it is important that the flow of fresh charge into the cylinder is directed away from the exhaust port means in order to reduce the loss of fresh charge by short-circuiting into the exhaust. Loop scavenging (Schnurle System) is the system adopted by virtually all modern engines in order to achieve good scavenging. In this system the transfer port means are symmetrically disposed relative to the exhaust port means and are directed towards the cylinder wall opposite the exhaust port means. The transfer port may enter the cylinder more or less tangential to the cylinder bore. Thus the port means are inclined at an angle to the centre line passing through the exhaust port means. This angle is normally 45° to 70°. It is impossible to manufacture such port means in a casting without using separate cores made in sand or soluble material and individually inserted into the mould or die before the metal is poured. This process does not lend itself to high rates of production in die-casting machines and results in two-stroke engines having a higher cost of production than modern side-valve four-stroke engines using pressure die-cast cylinder blocks.

Existing stepped piston engines of the type described in U.S. Pat. No. 3,550,569, although requiring less component parts than a side-valve four-stroke engine, involve loop scavenge type transfer port means as described above. This has hitherto prevented the stepped piston engine from achieving absolute minimum production costs by the use of die-cast cylinder blocks.

SUMMARY OF THE INVENTION

It is the object of the present invention to provide an engine of the kind specified which is constructed in such a way as to facilitate mass production and enable a low cost of manufacture to be achieved. More particularly, it is the object of the present invention to provide a form of cylinder for an engine of the kind specified which enables the ports and receiver volume or volumes to be formed in a single casting, e.g. die casting, operation, thereby reducing to a minimum the number of machining operations being required in manufacture of the engine. Such machining operations contribute materially to the cost of manufacture of an engine.

According to one aspect of the invention, there is provided a cylinder casting in an engine of the kind specified, comprising a bore of greater diameter to form said pumping part, a bore of lesser diameter to form said working part, exhaust port means in said working part, and opposed transfer port means on opposite sides of said working part disposed symmetrically about a plane passing through the longitudinal axis of the cylinder and the center of the exhaust port means, the transfer port means extending to the exterior of the casting and opening into respective first recesses to form receiver volumes, the transfer port means and first recesses being of a form to be produced in the casting process by non-separate cores introduced linearly towards said plane.

The transfer port means are preferably divergent, in the direction from the working part of the cylinder to the first recesses, about axes at right angles to said plane. Thus it is possible to die-cast these ports means without the use of separate cores which would involve extra costs in production.

These port means would not, by themselves, provide good scavenging, since the gas entering the cylinder would not be constrained to flow against the wall of the cylinder opposite the exhaust port means.

The desired flow may be provided by the internal form of said recesses provided on opposite sides of the cylinder. These recesses thus preferably, incorporate a wall extending to the central port of each recess. This wall ensures that the first charge approaches the transfer port means from the direction in which the exhaust port means is located and thus gas entering the working part of the cylinder from its port means is directed towards the wall of the cylinder opposite the exhaust port means.

This system provides good scavenging similar in quality to the existing (Schnurle) loop scavenging system described above.

The invention also provides an additional receiver valve cast integrally with the cylinder block. This is provided by means of a recess in the side of the cylinder block opposite the exhaust port means. This recess may be provided with two passages which communicate with the lower part of each of the first recesses previously described. Fresh charge from the receiver enters the first recesses below the aforementioned wall, flows round the inner form of the recess and approaches the transfer ports in the direction required.

The additional receiver recess and passages can be produced easily by die-casting without the use of separate cores. This additional recess is enclosed by a simple cover which may contain a reed valve which controls induction of fresh charge into the engine. The two first recesses may be closed by simple plates bolted or fixed by adhesive or other means to the cylinder block.

BRIEF DESCRIPTION OF THE DRAWINGS

These and other features of the invention will become apparent from the following description by way of example with reference to the accompanying drawings, of which.

Figure 1:
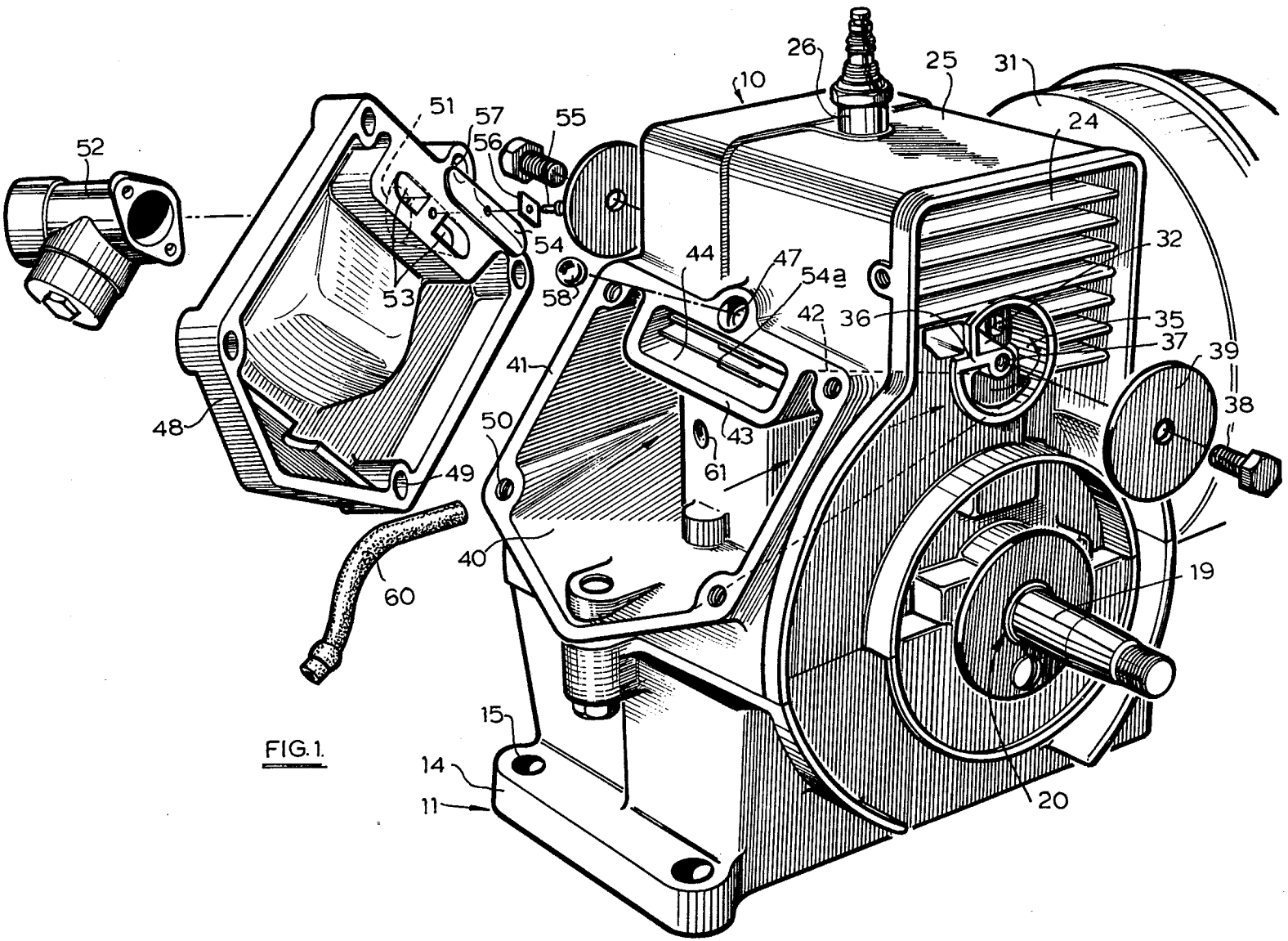
FIG. 1 is a perspective view of an engine embodying the invention, with some parts omitted and some parts shown exploded, for clarity.

Referring to the drawings, the engine there illustrated has a main stationary structure formed from two components, namely a first casting 10, herein termed the cylinder casting, which in fact forms the cylinder and upper part of the crankcase of the engine, and a second casting 11 which constitutes the lower part of the crankcase of the engine. The castings 10 and 11 meet along a joint plane 12, and are secured together by bolts 13. The casting 11 is provided on opposite sides with base flanges 14 provided with apertures 15 for enabling the engine to be bolted to a piece of equipment or apparatus which it is intended to power.

The cylinder casting 10 affords a stepped bore with a smaller diameter, working, part 16 and a larger diameter, pumping, part 17. A stepped piston 18 is received in the stepped bore of the cylinder, to operate within the working and pumping parts thereof. The engine has a crank shaft 19 mounted in main bearings, one of which is indicated generally at 20, between the casting 10, 11 and a connecting rod 21 which connects the piston 18 and crankshaft by way of a gudgeon pin 22 in the former and a big end journal 23 of the latter. The part of the cylinder casting 10 which affords the smaller diameter working part bore 16 is provided externally with cooling fins 24 and cowl 25 which provide for forced draught cooling of the cylinder from a crankshaft mounted fan, not shown. A spark plug 26 is received within a portion 27 of the casting 10 which forms the cylinder head of the engine.

Figure 3:
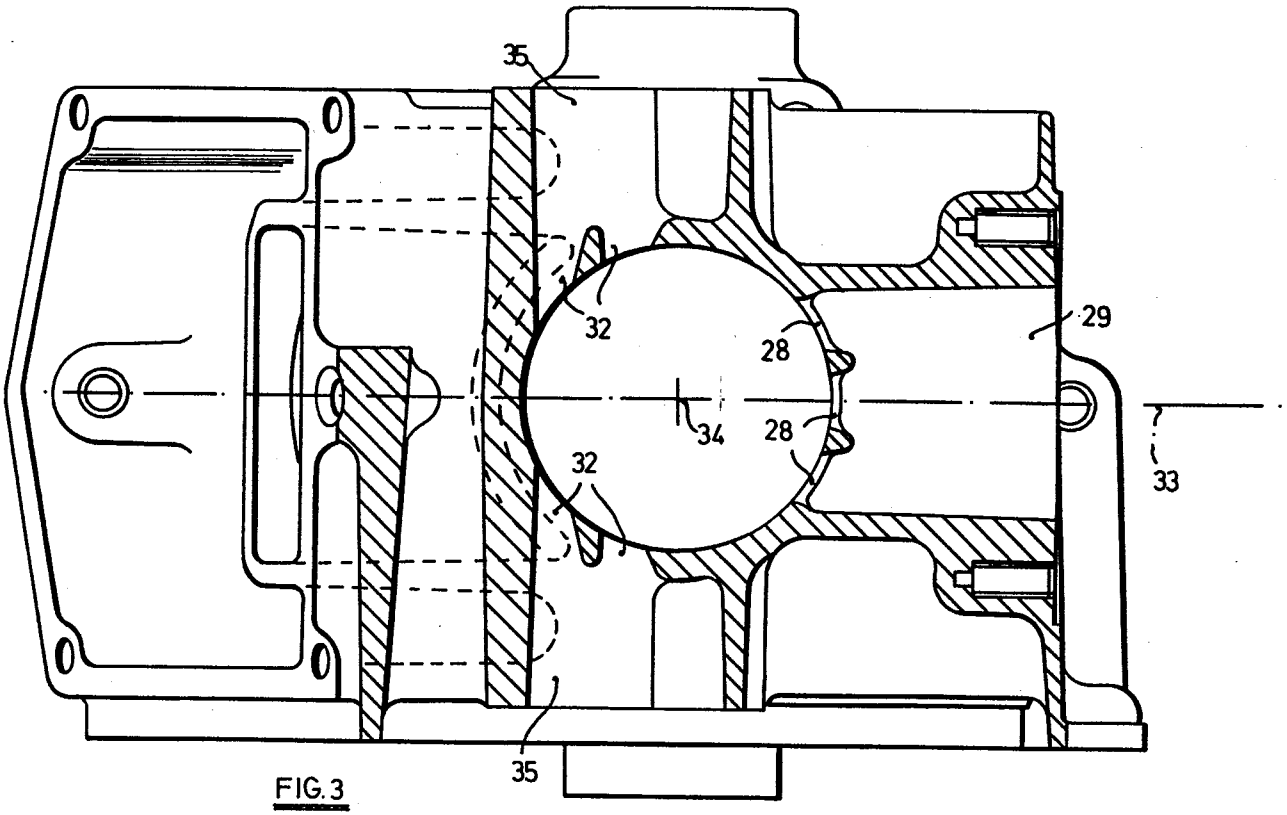
FIG. 3 is a horizontal section of the cylinder of the engine, on the line 3—3 of FIG. 2.

Referring now more particularly to FIG. 3 of the drawings, the wall of the working part bore 16 of the cylinder is formed with exhaust port means and transfer port means. The exhaust port means comprises three exhaust ports 28 which communicates with a single exhaust passage 29. The exhaust passage 29 terminates in a connection 30 to a silencer 31. The transfer port means comprises port means in the form of ports 32 disposed in pairs symmetrically on opposite sides of a plane 33 which contains the axis 34 of the cylinder and the center of the exhaust passage 29 and the central exhaust port 28. The transfer ports 32 extend to the exterior of the cylinder casting 10, opening into first recesses 35 on opposite sides of the cylinder casting. The shapes of recesses 35 are mirror images of one another, one of the recesses 35 being most clearly seen in FIG. 1. That recess is of circular shape as viewed in elevation, having the transfer ports 32 in its upper part above a wall formation 36 which extends horizontally from one side to the center of the recess, terminating in a boss 37 provided with a tapped bore for receiving a screw 38 for securing a removable circular cover member 39 to the cylinder casting, the cover member 39 closing the recess 35 so that the latter forms a receiver volume.

It will be noted that the walls which define the ports 32 and recesses 35, and the exhaust port 28 and the exhaust passage 29, are divergent, considered in the direction from the bore 16 to the exterior of the cylinder casting. This enables the ports 32 and recesses 35 to be formed in the casting process, which may be a die casting process, by non-separate cores introduced linearly in directions at right angles to the plane 33. Similarly the exhaust ports and passage can be formed by cores introduced in the direction of plane 33. In foundry terms, the walls of all these ports, the recesses, and the exhaust passage, have "draw". Further, the walls of the transfer ports 32 are so shaped as to direct gas flowing into the cylinder from them towards the cylinder wall opposite to the exhaust ports 28.

On the side of the cylinder casting opposite to the exhaust ports 28, the cylinder is formed with a further recess 40, which is formed in the process of casting the cylinder by a core introduced in the direction of plane 33 perpendicularly to the axis 34 of the cylinder. The recess 40 is of generally rectangular shape, being bounded by, on the exterior of the casting, a peripheral wall 41 terminating in a planar machined surface. On opposite sides of the plane 33, passages 42 extend to respective recesses 35 and open into the latter in their lower halves, i.e. beneath walls 36.

Within the boundary of recess 40, there is provided a further wall 43 which, with part of wall 41, defines an inlet passage 44 which branches into two inlet ports in the pumping part 17 of the cylinder at the upper end thereof. Also formed within the cylinder casting 10 is a breather passage 45 which extends upwardly from the open lower end of the casting 10 (i.e. communicates with the crankcase volume of the engine) parallel to the cylinder axis. At its upper end, a relatively small aperture 46 opens into a recess 47 formed in the planar surface of the upper part of wall 41 of recess 40.

The recess 40 is closed by a removable cover member 48, to form a receiver volume much greater than those formed by recesses 35, the cover 48 being secured to the cylinder casting 10 by bolts passing through apertures as 49 in the cover and engaging in tapped bores as 50 in the casting 10. A passage 51 extends through the cover 48, from a circular port in the outer side thereof which co-operates with the throat of a carburetor 52 bolted to the cover, to two apertures 53 with which co-operate respective ends of a reed valve element 54 secured at its centre to the cover member by a screw 55 and backing plate 56. The reed valve 54 controls passage of mixture from the carburetor to the inlet passage 44 and thus to the pumping part of 17 of the cylinder of the engine, permitting mixture to be drawn into the engine when a depression is formed in the pumping part of the cylinder upon downward movement of the piston but preventing blow back into the carburetor on upward movement of the piston. Ribs **54*a* within inlet passage 44 limit opening movement of the reed valve 54. An aperture 57 in the cover member provides for communication between recess 47 at the top of breather passage 45 and a duct 51*a* extending to the air inlet of the carburetor, a ball 58 being disposed in the recess 47** to control gas flow from the crankcase of the engine to the inlet.

At its lower end, the recess 40 is shaped to co-operate with the cover member 48 to form a well 59 in which any liquid fuel which may enter the recess 40 accumulates. A tube 60 extends from such well to communicate with a small aperture 61 leading into the pumping part 17 of the cylinder at a point somewhat below the region in which the inlet passage opens into the pumping part. This provides for introduction of any liquid fuel which may accumulate in the well 59 into the pumping part of the cylinder when there is a sub-atmospheric pressure in the pumping part, i.e. when the piston is descending.

Figure 2:
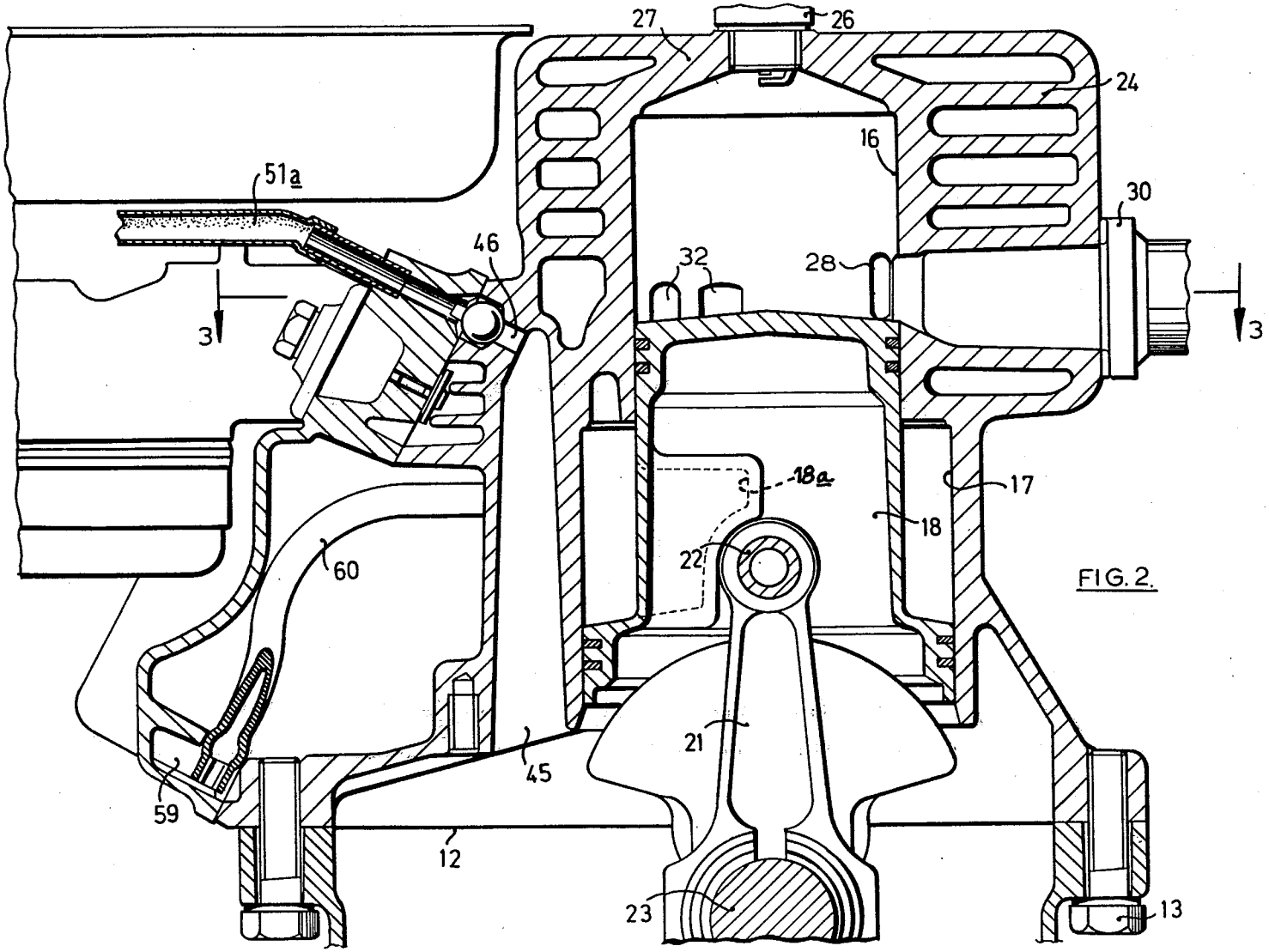
FIG. 2 is a vertical section through part of the engine of FIG. 1.

The method of operation of the engine is generally the same as that described in British Patent Specification No. 1,171,767 referred to above. When the piston descends, air-fuel mixture is introduced into the pumping part of the cylinder from carburetor 52 by way of inlet passage 44, and when the piston next ascends the mixture in the pumping part of the cylinder is compressed. The piston 18 is formed with recesses, one of which is shown at 18*a* in FIG. 2 which provide for communication between the pumping part of the cylinder and the transfer ports 32 when the piston is near the top dead centre position, and when such position is achieved the compressed mixture from the pumping part of the cylinder passes by way of such piston recesses into the transfer ports 32, recesses 35 and then by way of passages 42 to the larger receiver volume formed by recess 40. At or about this time, charge compressed in the working part of the cylinder (such charge being supplied thereto during the previous cycle of operation of the engine) is ignited by spark plug 26. The piston then descends again, and when it reaches a point at which the transfer ports 32 are uncovered by the top of the piston, mixture from the receiver volume constituted by recesses 40 and 35 enters the cylinder by way of transfer ports 32. Prior to this, the piston has uncovered exhaust ports 28 to permit the products of combustion of the charge to leave the cylinder. In flowing from the volume afforded by recess 40 to the cylinder, fresh mixture must flow around walls 36 in recesses 35, which assists in directing such mixture towards the rear wall of the cylinder opposite the exhaust port 28, so that the gas flow in the cylinder is generally as that for a conventional loop scavenged two stroke engine. The fresh mixture from the transfer ports flows around the cylinder in a manner which assists in expulsion of any remaining combustion products from the cylinder by way of the exhaust ports 28.

The present invention provides an engine which can be extremely economical to manufacture because no, or a minimum of, machining operations are required to form the various ports and passages. The exhaust ports, exhaust passage, transfer ports and recesses 35, recess 40 and passages 42, inlet passage 44, and breather passage 45, are all of a form such that they can be manufactured in the casting of the cylinder without the use of separate cores to form them. The cylinder casting may be formed from a suitable aluminium alloy, and may be manufactured by die-casting, in which case sufficient accuracy in the formation of ports and passages can be obtained not to require any machining to finish these features, although machining operations clearly are necessary to cut the various screw threads formed in the cylinder casting, finish the cylinder bores, etc. Alternatively techniques such as shell moulding may be employed in manufacture of the cylinder unit of the engine.

Although in the illustrated engine the castings 10 and 11 meet along a joint plane coincident with the axis of rotation of the crankshaft of the engine, the casting 10 may if desired afford substantially the entire crankcase structure of the engine. In this case, one of the walls of the crankcase accommodating a main bearing would be formed by a separate, removable, component, to provide for assembly of the engine, and a simple cover would be used to close the bottom of the crankcase. Such a construction could be advantageously employed for an engine intended to run with its crankshaft in a vertical orientation.

I claim:

1. A two-stroke internal combustion engine comprising a cylinder casting, a bore formed in said casting to provide a cylinder containing a stepped piston, the cylinder and piston having a pumping part of larger diameter and a working part of smaller diameter, exhaust port means in said working part, and opposed transfer port means on opposite sides of said working part disposed symmetrically about a plane passing through the longitudinal axis of the cylinder and the centre of the exhaust port means, the transfer port means extending to the exterior of the casting and opening into respective first recesses to form receiver volumes, the transfer port means and first recesses being of a form to be produced in the casting process by non-separate cores introduced linearly towards said plane, said receiver volume being arranged to receive, in use, through said transfer port means a charge from the pumping part of the cylinder and to deliver through said transfer port means the charge to the working part of the cylinder, the piston being provided with recess means which co-operate with the transfer port means to allow and control entry of the charge into said receiver volumes, the piston also co-operating with the transfer port means to allow and control entry of charge from said receiver volumes to the working part of the cylinder.

2. An engine according to claim 1 wherein the transfer port means are divergent, in the direction from the working part of the cylinder to the first recesses, about axes at right angles to said plane.

3. An engine according to claim 1 comprising a further recess to form an additional receiver volume, communicating with the first recesses and formed by a core introduced in the direction of said plane.

4. An engine according to claim 3 wherein the further recess is on the opposite side of the casting to the exhaust port means.

5. An engine according to claim 4 wherein said further recess is of a much greater volume than the first recesses.

6. An engine according to claim 5 wherein the transfer port means opens into the first recesses in the upper part thereof, and such recesses communicate with the further recess in their lower parts, the first recesses being provided with formations around which gas must flow in passing from the further recess to the transfer port means whereby gas entering the working part of the cylinder from the transfer port means is directed towards the wall of the cylinder opposite the exhaust port means.

7. An engine according to claim 3 wherein said first recess and further recess are bounded by a wall terminating in a planar boundary surface each adapted to receive a removable cover member to define said receiver volume.

8. An engine according to claim 7 further comprising an inlet passage extending from said bore of greater diameter and having a mouth which lies within the boundary surface of the further recess and coplanar therewith.

9. An engine according to claim 7 further comprising a breather passage extending generally parallel to the longitudinal axis of the cylinder from a lower region thereof, which forms the crankcase volume of the engine to an opening in a surface co-planar with and adjacent said boundary surface of the further recess.

10. An engine according to claim 3 wherein the bottom of the further recess is formed as a well to accumulate any liquid entering, or forming in, said recess and means are provided for introducing any of said accumulated liquid from said well into said pumping part of the cylinder.

11. An engine according to claim 8 wherein the removable cover member closing said further recess affords an inlet passage which on one side of the cover member communicates with said inlet passage in the cylinder casting and on the other side of the cover member is adapted to communicate with a carburetor.

12. An engine according to claim 11 wherein a reed valve for controlling charge flow through said inlet passage is mounted on said cover member.

13. An engine according to claim 11 comprising a breather passage extending generally parallel to the longitudinal axis of the cylinder from a lower region thereof, which forms the crankcase volume of the engine to an opening in a surface co-planar with and adjacent said boundary surface of the further recess, wherein said cover member of said further recess is provided with a further passage to provide communication between said opening of said breather passage and the air inlet to the carburetor.

* * * * *